United States Patent [19]

Gonzalez R.

[11] 4,214,384

[45] Jul. 29, 1980

[54] REPLACEABLE HEEL CONSTRUCTION FOR SHOES

[76] Inventor: Ricardo Gonzalez R., Carrera 13 No. 37-43, Piso 12, Bogota, Colombia

[21] Appl. No.: 952,391

[22] Filed: Oct. 18, 1978

[51] Int. Cl.[2] ..... A43B 21/36

[52] U.S. Cl. ..... 36/42; 36/36 R

[58] Field of Search ..... 36/42, 36 R, 36 A, 36 B, 36/36 C, 41

[56] References Cited

U.S. PATENT DOCUMENTS

| | | | |
|---|---|---|---|
| 2,252,404 | 8/1941 | Mauser | 36/36 R |
| 2,582,551 | 1/1952 | Malherbe | 36/42 |
| 3,188,755 | 6/1965 | Cortina | 36/42 |

FOREIGN PATENT DOCUMENTS

| | | | |
|---|---|---|---|
| 669442 | 8/1963 | Canada | 36/36 R |
| 29556 | of 1913 | United Kingdom | 36/36 R |

*Primary Examiner*—James Kee Chi

*Attorney, Agent, or Firm*—Phillips, Moore, Weissenberger, Lempio & Majestic

[57] ABSTRACT

A shoe has a first coupling element secured on a heel portion thereof and a second coupling element, defining a heel thereon, is slidably mounted in interlocking relationship on the first coupling element. A resilient locking tab on the second coupling element engages a locking groove formed on the first coupling element and is held in locked relationship therein by a removable wedge.

5 Claims, 5 Drawing Figures

REPLACEABLE HEEL CONSTRUCTION FOR SHOES

BACKGROUND OF THE INVENTION

A conventional heel construction for mens' or womens' shoes normally comprises a heel which is secured to the shoe by glue and/or nails. Upon wearing-down of the heel, the old heel must be stripped-off the shoe and replaced by a new one. This procedure is time-consuming and relatively expensive and also requires the precise positioning of the heel on the shoe. Furthermore, the new heel normally requires grinding and buffing to properly size it on the shoe.

SUMMARY OF THIS INVENTION

An object of this invention is to provide an improved heel construction whereby a heel may be replaced on a man's or woman's shoe expeditiously and economically. The replaceable heel construction of this invention comprises a first coupling element secured on the heel portion of the shoe and a second coupling element slidable mounted in interlocking relationship on the first coupling element and defining a shoe heel thereon. Means are provided for releasably securing the second coupling element to the first coupling element whereby the second coupling element, having the shoe heel formed thereon, may be replaced expeditiously upon wearing thereof.

BRIEF DESCRIPTION OF THE DRAWINGS

Other objects of this invention will become apparent from the following description and accompanying drawings wherein.

DETAILED DESCRIPTION

Figure 1:
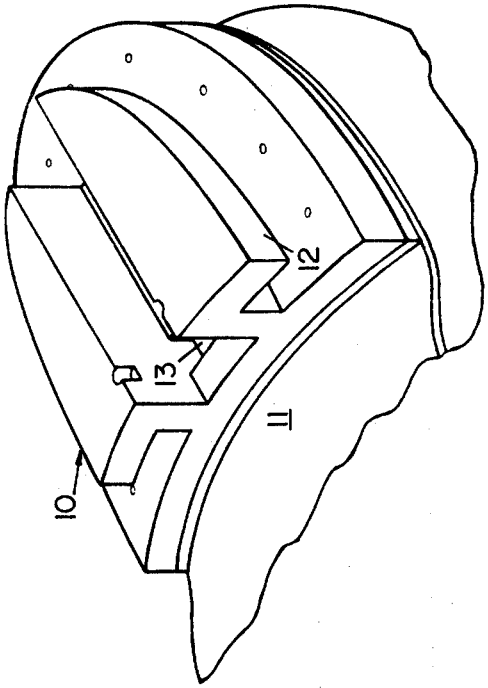
FIG. 1 is an isometric view of a heel portion of a shoe having a first coupling element of the replaceable heel construction of this invention secured thereon.

FIG. 1 illustrates a first coupling element 10 of the replaceable heel construction of this invention shown secured by glue, nails or the like to a sole 11 of a heel portion of a shoe. The coupling element comprises a pair of laterally extending and horizontally disposed wings 12 having curved outer edges which taper rearwardly for purposes hereinafter explained. It should be understood that coupling element 10 could be molded to be integrally formed with sole 11, if so desired. An elongated channel is defined between wings 12 and has a locking groove 13 defined therein, towards the forward end of coupling element 10.

Figure 2:
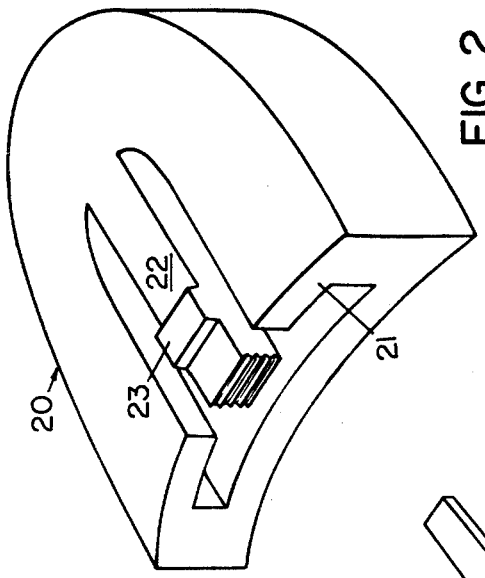
FIG. 2 is an isometric view of a second coupling element, adapted to be mounted on the first coupling element of FIG. 1, having a heel defined thereon.

Referring to FIG. 2, a second coupling element 20 of the replaceable heel construction of this invention comprises a pair of inwardly extending flanges 21 having a flexible stem disposed in cantilevered relationship between the flanges. The stem extends forwardly on coupling element 20 and terminates adjacent the free end thereof at a resilient locking tab 23 which is adapted to engage locking groove 13 (FIG. 1) in locked relationship therewith, as hereinafter described. Furthermore, serrations (not numbered) are formed on the extreme end of stem 22 to be gripped for release of locking tab 23 from locking groove 13, as also hereinafter more fully described.

It should be understood that coupling element 20, defining a heel thereon, is composed of a standard rubber or plastic heel material which will exhibit sufficient elastomeric properties and flexibility to facilitate the hereinafter described coupling of elements 10 and 20 together. Coupling element 10 may be constructed in a like manner. A standard leather heel layer may be secured exteriorly on coupling element 20, if so desired.

Figure 3:
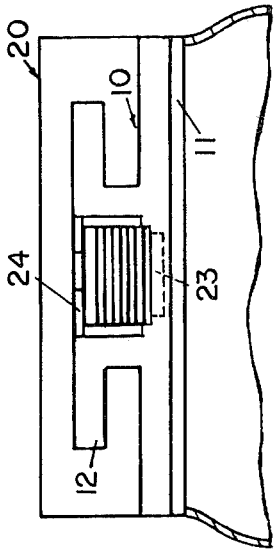
FIG. 3 is a rear elevational view of the composite heel construction showing the first and second elements coupled together in interlocking relationship.

Referring to FIG. 3 and assuming that coupling element 20 in FIG. 2 has been turned-over 180°, the slot defined in coupling element 20 is positioned to receive wings 12 of coupling element 10. Upon full insertion of wings 12 in such slot whereby flanges 21 will underly the wings, the slot generally conforming to the configuration of wings 12 of coupling element 10, resilient locking tab 23 will snap-down into locking groove 13, as shown in FIG. 3.

Figure 5:
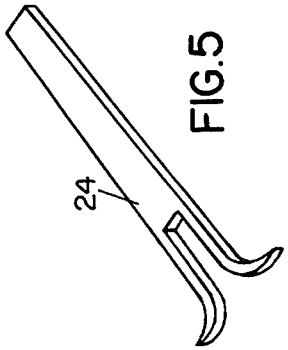
FIG. 5 is an isometric view illustrating a wedge adapted to be inserted between the first and second coupling elements to releasably secure them together.

A wedge 24, more clearly illustrated in FIG. 5, is then inserted between the flat surface of stem 22 and a flat opposing surface portion of coupling member 20 to wedge locking tab 23 downwardly into locked relationship in groove 13 of coupling member 10. Wedge 24, which may be composed of a metal or plastic material exhibiting sufficient springback and flexibility characteristics for the following purpose, has a pair of outwardly disposed flexible fingers (FIG. 5) which bend towards each other upon insertion of wedge 24 in place and then spring-back to engage the unnumbered notches illustrated in FIG. 1, formed on the inner sides of wings 12. Such engagement will thus prevent disengagement of tab 23 from groove 13.

Should it be desired to remove coupling element 20, having the wearable heel formed thereon, from coupling element 10, a person need only depress his thumb against the serrated end of stem 22 to depress the stem downwardly for release of wedge 24 from the notches illustrated on wings 12 in FIG. 1. Removal of the wedge will then permit compression of stem 22 upwardly to release tab 23 from groove 13 whereby coupling element 22 may be removed from coupling element 10.

Figure 4:
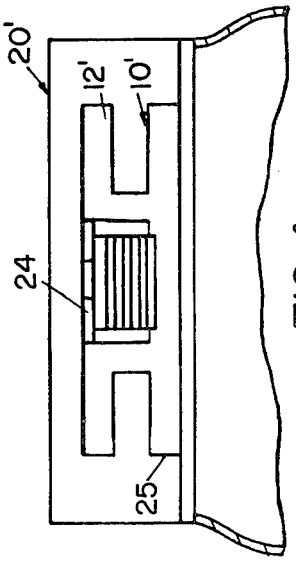
FIG. 4 is a view similar to FIG. 3, but illustrates a modification of the replaceable heel construction of this invention.

FIG. 4 illustrates a modification of the replaceable heel construction of this invention wherein a first coupling element 10' has wings 12' formed thereon, corresponding to wings 12 in FIGS. 1–3, which coincide with a base 25 of coupling element 10'. The heel defined on a second coupling element 20', corresponding to coupling element 20 in FIGS. 1–3, thus extends completely down to the sole of the shoe and is uninterrupted when viewed exteriorly. The slot formed in second coupling element 20' will, of course, closely approximate the configuration of wings 12' and base 25 of first coupling element 10' to facilitate the illustrated coupling together of the elements. It should be further noted that wedge 24 is inserted in place to retain the elements in locked condition, in the manner described above.

I claim:

1. A replaceable heel construction for shoes comprising a first coupling element, a second coupling element slidably mounted in interlocking relationship on said first coupling element and defining a shoe heel thereon, a flexible stem mounted in cantilevered relationship on said second coupling element, and means for releasably securing said second coupling element to said first coupling element comprising a locking tab formed externally on said stem and disposed in a locking groove defined on said first coupling element, and releasable wedge means for forcing said locking tab into said locking groove.

2. The replaceable heel construction of claim 1 wherein said first coupling element comprises a pair of laterally spaced and horizontally disposed wings disposed in a slot defined in said second coupling element.

3. The replaceable heel construction of claim 2 wherein said second coupling element further comprises a pair of flanges formed thereon to extend inwardly towards each other, each of said flanges underlying a respective one of said wings in interlocked relationship therewith.

4. The replaceable heel construction of claim 3 wherein an elongated groove is defined between said wings and wherein said flexible stem is mounted in cantilevered relationship between said flanges, said stem disposed in said groove.

5. The replaceable heel construction of claim 1 wherein said wedge means comprises an elongated wedge having a pair of flexible fingers on an end thereof and wherein ends of said fingers are engaged within notches defined in said first coupling element.

* * * * *